US008193949B2

(12) United States Patent
Burns

(10) Patent No.: US 8,193,949 B2
(45) Date of Patent: Jun. 5, 2012

(54) ALERT AND WARNING SYSTEM AND METHOD

(75) Inventor: Chester Allen Burns, Reno, NV (US)

(73) Assignee: Spot Devices, Inc., Sparks, NV (US)

( * ) Notice: Subject to any disclaimer, the term of this patent is extended or adjusted under 35 U.S.C. 154(b) by 0 days.

(21) Appl. No.: 12/851,487

(22) Filed: Aug. 5, 2010

(65) Prior Publication Data

US 2010/0295708 A1 Nov. 25, 2010

Related U.S. Application Data

(63) Continuation of application No. 11/807,103, filed on May 25, 2007, now Pat. No. 7,772,996.

(51) Int. Cl.
*G08G 1/123* (2006.01)

(52) U.S. Cl. ..... 340/991; 340/993; 340/988

(58) Field of Classification Search ..... 340/426.18, 340/426.19, 426.2, 426.21, 426.22, 438, 340/439, 539.1, 539.13, 425.5, 988, 989, 340/991, 993, 994; 701/19, 117, 118, 201
See application file for complete search history.

(56) References Cited

U.S. PATENT DOCUMENTS 5,602,739 A 2/1997 Haagenstad et al.
5,699,986 A 12/1997 Welk
5,926,113 A 7/1999 Jones et al.
5,986,575 A 11/1999 Jones et al.
6,006,159 A 12/1999 Schmier et al.
6,243,026 B1 6/2001 Jones et al.
6,278,936 B1 8/2001 Jones
6,313,760 B1 11/2001 Jones
6,317,060 B1 11/2001 Jones
6,374,176 B1 4/2002 Schmier et al.
6,384,776 B1 5/2002 Martin
6,411,891 B1 6/2002 Jones
6,415,207 B1 7/2002 Jones
6,519,512 B1 2/2003 Haas et al.
7,271,736 B2 9/2007 Siegel et al.
7,460,948 B2 12/2008 Van Buer et al.
2002/0008637 A1 1/2002 Lemelson et al.
2002/0135504 A1 9/2002 Singer
2004/0249571 A1 12/2004 Blesener et al.
2006/0095199 A1 5/2006 Lagassey
2006/0247849 A1 11/2006 Mohsini et al.
2006/0276199 A1 12/2006 Flick

*Primary Examiner* — Van T. Trieu
(74) *Attorney, Agent, or Firm* — Alston & Bird LLP

(57) ABSTRACT

The present inventions provide a system and method for providing a warning using at least one wireless communication link between an approaching object and the location where a warning is to be given based in part on the location of the object and its proximity to the warning location. One aspect of the inventions includes receiving a communication from an object, for example a vehicle, which includes location information, at an alert node, wirelessly communicating alert information to a warning node, and causing a warning device to generate a warning. Preferably the alert node communicates with a plurality of vehicles and a plurality of warning nodes and determines to which of the plurality of warning nodes to communicate alert information based in part on the location information received from at least one of the vehicles and the location of the warning device.

59 Claims, 9 Drawing Sheets

ALERT AND WARNING SYSTEM AND METHOD

This application is a continuation of U.S. patent application Ser. No. 11/807,103, filed May 25, 2007, now U.S. Pat. No. 7,772,996, issued on Aug. 10, 2010.

FIELD OF THE INVENTIONS

The present inventions pertain to the field of providing an alert based on the location of a moving object, including in particular to provide an advance warning of approaching vehicles to predetermined locations.

BACKGROUND

When two paths cross, it is important to be able to provide warnings of the approach of an object, for example, a vehicle or a person, to the area where the paths cross. This is particularly so when two vehicles or a vehicle and a person approach the same intersection of vehicle paths to give operators of the vehicles and the pedestrian ample warning about the potentially dangerous situation. Many warning devices are used to notify people of oncoming vehicles. In case of railroad crossings, car drivers and pedestrians are usually notified by visual signals, such as flashing lights or traffic signals, audio signals, crossing gates, etc. In the case of emergency vehicles approaching an intersection, the public is typically notified of their approach by colored flashing lights and/or sirens mounted on the emergency vehicle. In the case of watercraft, warnings of an approaching navigation obstacle include flashing lights and audio signals on the known obstacle, radar, etc.

These warning devices are typically either on constantly, as in the case of a buoy, or activated when the potentially dangerous situation begins to present itself such as physically, usually visually, detecting an approaching vehicle and causing the warning device to be activated.

Physical detection can be adversely affected by such parameters as sensitivity to weather conditions, surrounding terrain, etc. Also, when physical detection is used, the lead time between the activation of the warning device and the time the vehicle crosses the intersection of paths, may be affected by the speed of the approaching vehicle such as in situations where there is a presence at a set distance from the vehicle path crossing. A good example is the locator devices at a railroad crossing. The train detectors are generally set a standard fixed distance from the road crossing. If the detector is 1 mile from the crossing, the advance warning when the train is going 100 miles an hour is 1/10 the time when the train is going 10 MPH. When warning signals are active all the time, such as ambulance sirens or flashing lights on a buoy, the advance warning is limited by how far the light and sound of the warning device travels and how far the pedestrians and vehicle operators can see.

Another problem with known warning systems today is that they can be very expensive to install in remote areas. While the advent of use of solar powered batteries has helped to address this, cost of the units themselves, installation, monitoring and maintenance of these systems can still be a barrier to putting warning systems everywhere that a potentially dangerous situation exists. Also, with regard to marine vehicle crossings, it is very difficult to use any other system than a constant warning device because of the difficulty and cost of placing sensors to detect the approach of a watercraft.

What is needed is a low-cost but effective and reliable system and method for among other things, warning pedestrians and vehicle operators of the approach of vehicles at vehicular path crossings.

SUMMARY OF THE INVENTIONS

The present inventions provide a system and method for providing a warning using at least one wireless communication link between an approaching object and the location where a warning is to be given based in part on the location of the object and its proximity to the warning location. One aspect of the inventions includes receiving a communication from an object, for example a vehicle, which includes location information, at an alert node, wirelessly communicating alert information to a warning node, and causing a warning device to generate a warning. Preferably the alert node communicates with a plurality of vehicles and a plurality of warning nodes and determines to which of the plurality of warning nodes to communicate alert information based in part on the location information received from at least one of the vehicles and the location of the warning device.

Another aspect of the inventions includes a scalable warning network. For example there may be a single alert node associated with a plurality of warning nodes in a specific alert node geographic area and each of the warning nodes can be associated with a plurality of warning devices in a portion of that geographic area. In some embodiments the warning nodes can be co-located with associated warning devices while in other embodiments the warning nodes can be remotely located from the associated warning devices, or a combination of both. In still other embodiments, there can be a plurality of alert nodes that communicate with each other or with one or more host alert nodes.

In one embodiment the alert node receives position information from a position information unit, determines whether the vehicle associated with the position information unit is in one of a plurality of alert zones based in part on the position information, determines which warning node is associated with the warning device in the alert zone, and generates a wireless alert transmission. The wireless alert transmission is received by the warning node which causes the warning device in the alert zone to generate a warning. Preferably, a satellite navigation system network is used to determine the vehicle position.

In other embodiments there is a plurality of alert zones associated with warning devices and a plurality of vehicles. The alert node is configured to receive position information from all vehicles within its communication zone and determines whether any or all of the vehicles are in any of the alert zones. When one or more vehicles are in one or more alert zones, the alert node communicates alert information to the warning devices in the alert zones in which the vehicles are located.

One aspect of the various embodiments of the present inventions is to provide an adequate advance warning to people about to cross the path of an approaching vehicle. One embodiment notifies people close to the crossing about the approaching vehicle independent of local conditions, for instance local weather, vehicle speed or surrounding terrain. Advance information about conditions at the crossing to the operator of the approaching vehicle can also be provided. More than one way of assessing vehicle location and communication between the warning network components is preferably employed thereby increasing reliability.

DETAILED DESCRIPTION OF THE DRAWINGS

Figure 1:
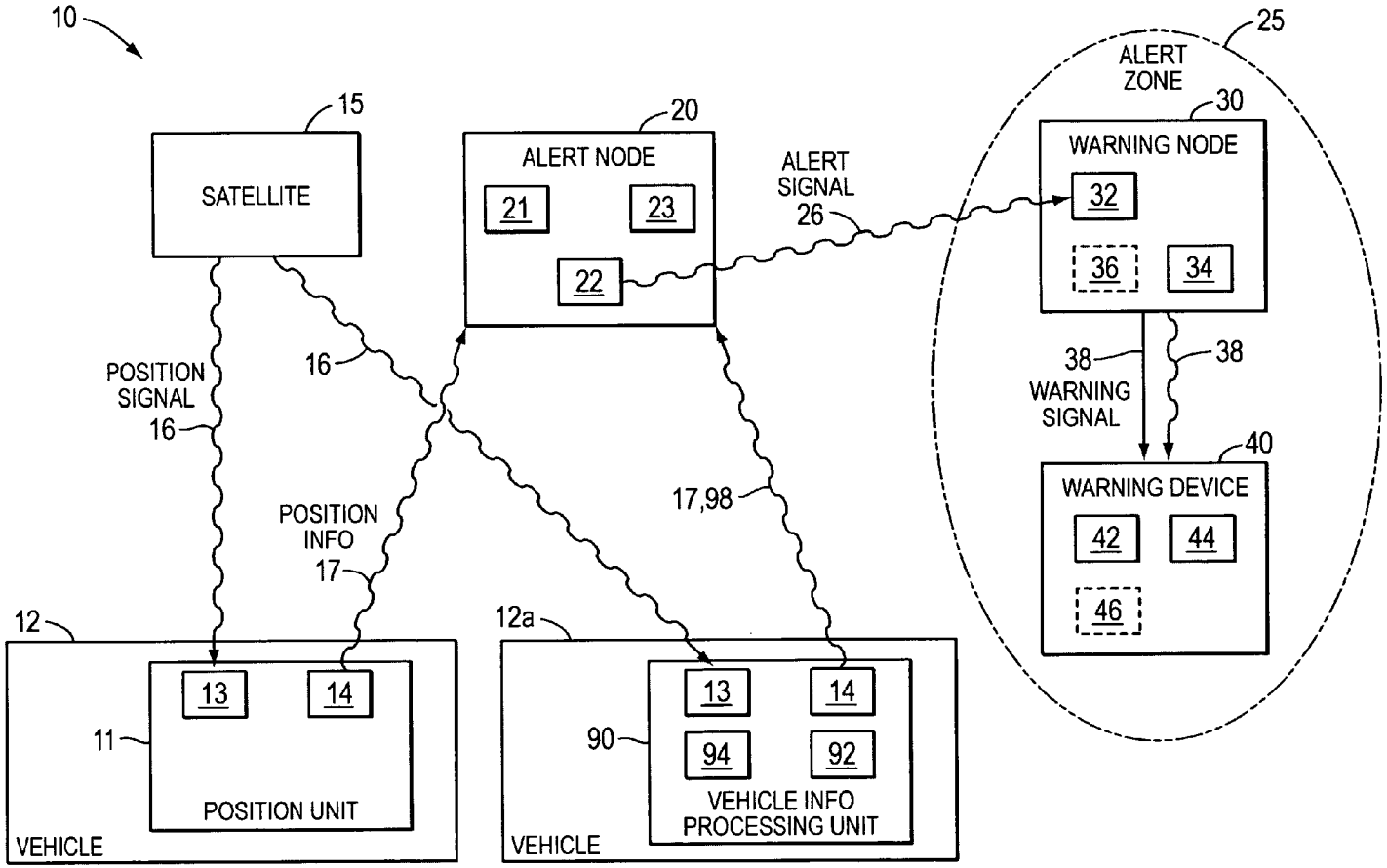
FIG. 1 is a diagram of a preferred embodiment of a warning network.

FIG. 1 is a warning network 10 in accordance with one aspect of the present invention. The warning network 10 preferably comprises a vehicle position unit 11, attached to a vehicle 12. The vehicle position unit 11 preferably includes a position determiner 13 and a vehicle transmitter 14. The position determiner 13 may be any known system that is capable of providing location coordinates of the vehicle. Preferably, the position determiner is a GPS receiver that receives GPS signals 16 from GPS satellites 15. The vehicle transmitter 14 preferably transmits vehicle position information which preferably includes the vehicle's coordinates via a position information communication 17 to an alert node 20.

The alert node 20 preferably includes an alert node processing unit 21, an alert node transmitter 22 and alert node storage 23. The alert node processing unit 21 is configured to receive information stored in the alert node storage 23 and to generate alert signals under specified conditions. The alert node 20 receives as an input the position information communication 17 and the alert node processing unit 21 extracts the vehicle coordinates. The alert node processing unit 21 is configured to determine whether the vehicle is in an alert zone 25.

An alert zone 25 is preferably a geographically defined location a known distance from a warning device 40. The warning device 40 is preferably located in near proximity to an intersection of two paths, for example a train track and road. The warning device 40 includes warning device electronics and may include multiple warning signal devices such as flashing lights, sirens, and/or gates. The warning device 40 is associated with warning node 30. The warning node 30 preferably includes a warning node wireless receiver 32 and a warning node processing unit 34. The warning node 30 is preferably associated with the warning device 40 and is preferably co-located with the warning device 40. In a preferred embodiment the warning node 30 and the warning device electronics 42 are housed in the same electrical housing. Alternatively the warning node 30 and the warning device 40 are remote from each other. In this remote location embodiment the warning device 40 preferably also includes a warning device wireless receiver 46 configured to communicate with the warning node transmitter 36.

The alert node transmitter 22 is configured to be able to communicate with the warning node receiver 32. When the alert node processing unit 21 determines that the vehicle 12 is in an alert zone 25, it generates an alert signal 26 and causes the alert node transmitter 22 to communicate the alert signal 26 to the warning node 30 associated with the warning device 40 in the alert zone 25 occupied by the vehicle 12. The warning node receiver 32 receives the alert signal 26 as an input and, after processing, the warning node processing unit 34 outputs a warning signal 38 to the warning device 40. In alternative embodiments there may be a delay between the processing and the outputting of the warning signal 38. The warning device electronics 42 receives the warning signal 36 as an input and activates the warning signal or warning signals 44.

In one embodiment the warning system includes a vehicle information processing unit 90 attached to the vehicle 12*a*. The vehicle information processing unit 90 preferably includes a vehicle information determiner 13, a vehicle information processor 92, a vehicle storage device 94 and a vehicle transmitter 14. In this embodiment the vehicle information determiner 13 outputs vehicle position information which is made accessible to the vehicle information processor 92. Preferably alert zone information and alert node information is stored in the vehicle storage device 94. The vehicle position information and the information stored in the vehicle storage device is also accessible to the vehicle information processor 92. The vehicle information processor 92 based in part on the vehicle position information and the alert zone information determines whether the vehicle is in an alert zone. When the vehicle information processor 92 determines that the vehicle is in an alert zone, appropriate signals or commands are communicated to the vehicle transmitter 14 to cause the vehicle transmitter 14 to transmit position information to the alert node 20. In this embodiment the alert node 20 uses the position information 17 as described above. The advantage of this presently preferred embodiment is that the position information 17 is only sent when the vehicle is in an alert zone thus eliminating unnecessary communications.

In an alternative embodiment, the vehicle transmitter 14 transmits a vehicle alert signal 98 to the alert node 20. In this embodiment the vehicle alert signal 98 preferably comprises vehicle position information, alert zone information and other system maintenance information. In this embodiment the alert node has the option of operating as described above and/or simply retransmitting the vehicle alert signal as an alert signal to the appropriate warning node. In this embodiment the alert node 20 could also use the information in the vehicle alert signal to monitor the operation of the vehicle processing unit.

Depending upon the application, the alert zone 25 may be a series of coordinate pairs surrounding the warning device 40 or a single coordinate pair. In a train crossing embodiment the alert zone 25 is preferably two coordinate pairs each defining a location a predetermined distance on the railroad track in each direction away from the road crossing.

Figure 2:
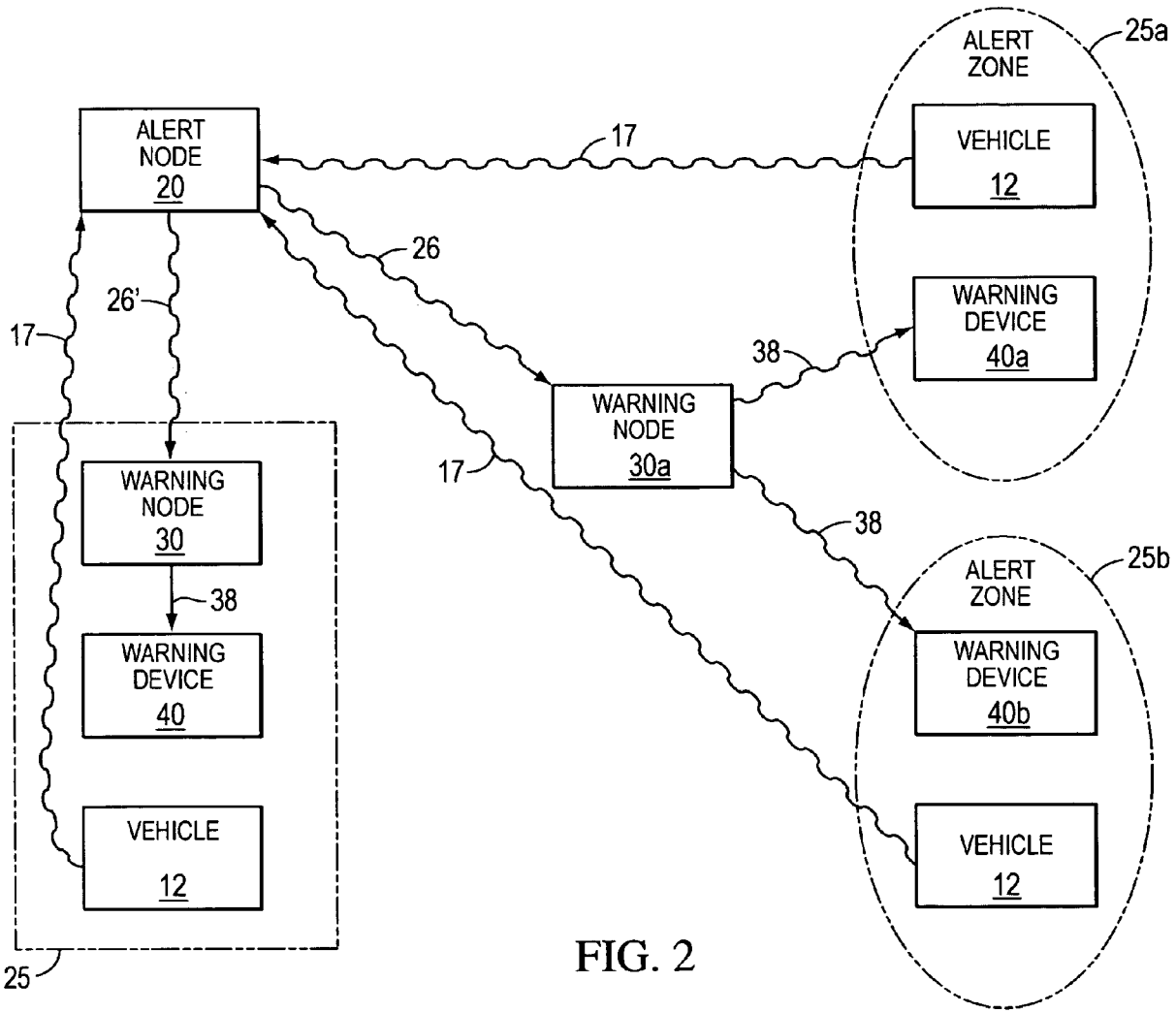
FIG. 2 is a diagram of another embodiment of the warning network with a plurality of warning nodes and a single alert node.

A preferred alert node network is shown in FIG. 2 and, preferably includes a plurality of warning nodes 30 associated with a single alert node 20. The vehicles are not depicted for clarity. The alert node transmitter 22 is configured to communicate an alert signal 26 to a selected warning node 30. Also in this embodiment at least one of the warning nodes 30*a* is associated with at least two warning devices 40*a* and 40*b*, with warning device 40*a* associated with alert zone 25*a* and warning device 40*b* associated with alert zone 25*b*. In this embodiment the alert signal 26 is preferably directed to a particular warning node 30 and includes warning device identification information so that the warning node receiving the alert signal 26 knows which of the associated warning devices to activate. In this embodiment the alert signal 26 may be a broadcast signal that includes warning node identification information so that the particular warning node associated with the warning device 40 in the occupied alert zone 25 will be able to determine that it should generate a warning signal 38. Similarly, the warning signal 38 may be either directed at a particular warning device 40 or may include warning device identification information in a broadcast signal.

The position information 17 transmitted from each of the vehicles may include vehicle identification information so the alert node 20 knows which vehicle is in which alert zone.

Figure 3:
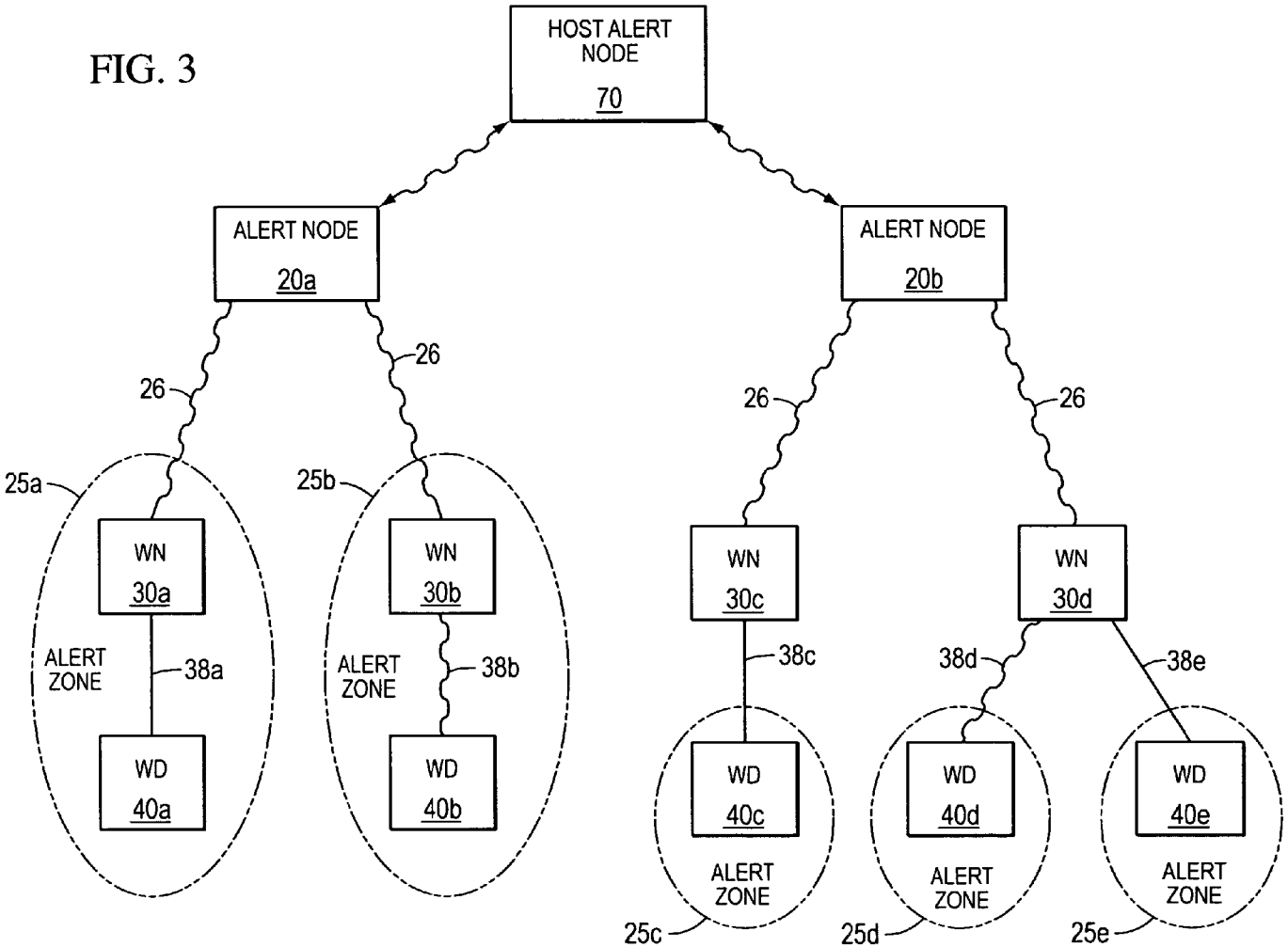
FIG. 3 is a diagram of another embodiment of the warning network with a plurality of alert node networks.

Preferably the alert network includes a plurality of alert node networks. FIG. 3 depicts a preferred embodiment comprising at least two alert node networks, alert node network 20*a* and alert node network 20*b*. The vehicles 12 are not shown merely for simplicity in understanding the network but would communicate their position in a broadcast signal that would be received by the appropriate alert node. In this embodiment each of the alert nodes 20*a* and 20*b* is configured to communicate with its associated warning nodes which in turn communicate with their associated warning devices. In this exemplary embodiment, warning signals 38*a, c* and *e* are communicated over wire and warning signals 38*b* and *d* are communicated wirelessly Preferably alert node 20*a* and alert node 20*b* are configured to be able to communicate with each other. This may be accomplished over a wireless communication or preferably through a direct internet connection. Preferably the alert nodes 20*a* and 20*b* will provide status information to the other node. The status information would preferably include information to allow the other alert node to determine whether it is operational. In the case that one of the two alert nodes is non-functional, alert node 20*a* may be configured to communicate with the warning nodes associated with alert node 20*b* and vice versa to provide redundancy and reliability.

In an alternative embodiment, the alert nodes 20*a* and 20*b* may communicate with a host alert node 70. Host alert node 70 may have its own alert node network and also be configured to monitor the status of any other alert nodes. If one or more of the alert nodes failed, the host alert node 70 could reassign warning nodes to ensure full coverage and avoid overloading any one alert node.

Figure 4:
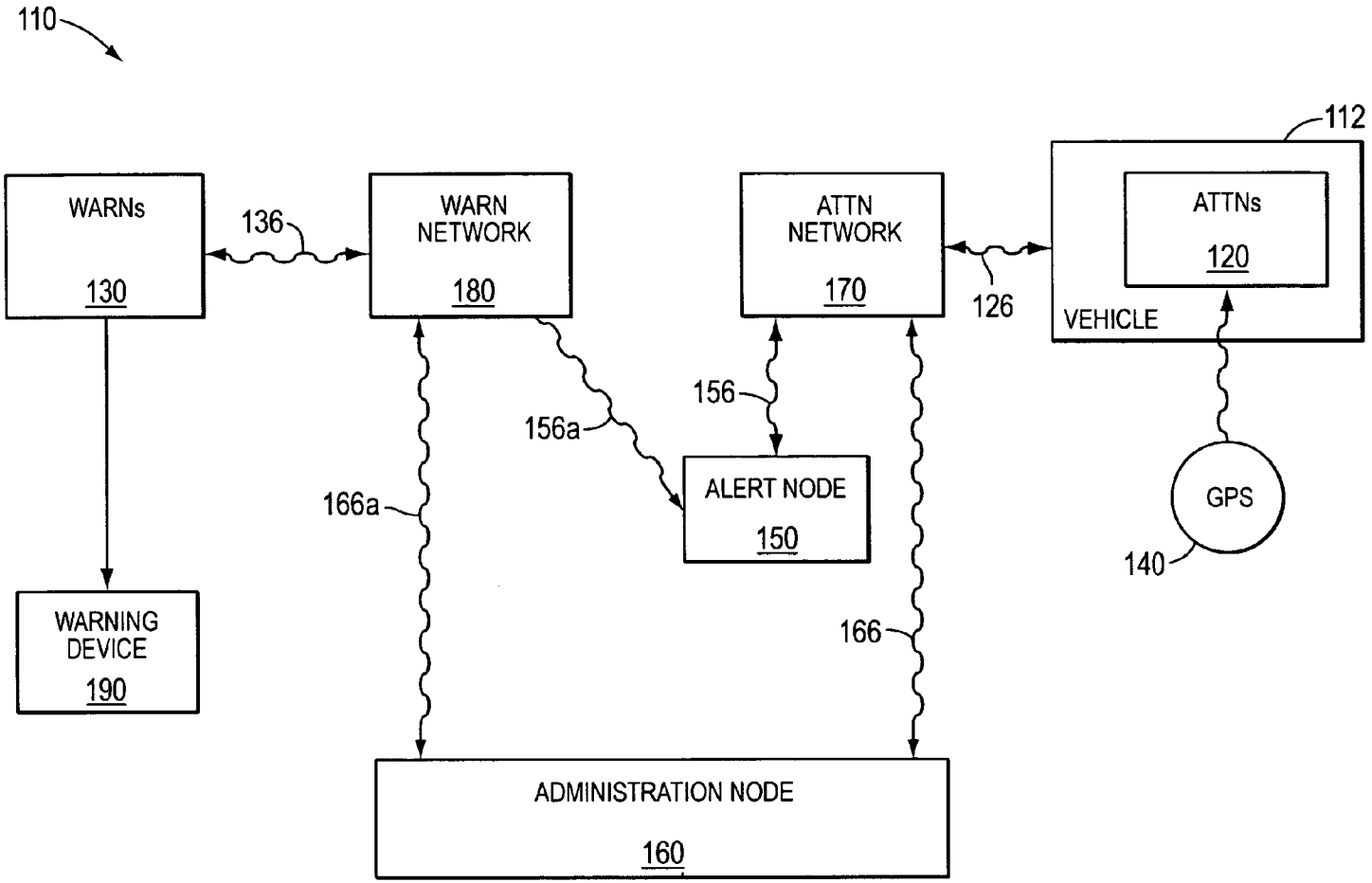
FIG. 4 is a schematic representation of one embodiment of the present inventions.

FIG. 4 depicts a preferred Proximity Alert and Warning System (PAWS) 110 embodying aspects of the present inventions. The PAWS preferably comprises an Alert Trigger Transmit Node (ATTN) 120, a Warning Alert Response Node (WARN) 130, a warning device 190 and an alert node 150. ATTN 120 is preferably attached to a vehicle of interest 112 and preferably receives a vehicle position signal from a satellite navigation system, most preferably a GPS satellite 140. The PAWS 110 preferably includes an ATTN wireless link 126 from the ATTN 120 to an ATTN network 170. The ATTN wireless link 126 and ATTN network 170 communication path can be realized by a cellular phone network, PCS network, public internet, any kind of virtual private network, etc., or may be implemented using satellite links, terrestrial media or any other suitable media. The alert node is preferably configured to communicate with the ATTN network over an AN wireless link 156.

The ATTN wireless link 126, ATTN network 170 and AN wireless link 156 communication path is configured to allow the ATTN 120 to communicate with the alert nodes 150. Alert node 150 is preferably configured to receive vehicle position information in real time, determine whether the vehicle is in an alert zone, determine which WARN is in the alert zone, log the locations of vehicles equipped with ATTNs 120, generate time stamps for receipt of information, generate alert signals to be sent to WARNs, transmit alert signals to WARNs, log the set of WARNs notified and other relevant information.

The PAWS 110 preferably includes a WARN wireless link 136 from the WARN 130 to a WARN network 180. The WARN wireless link 136 and network 180 communication path can be realized by a cellular phone network, PCS network, public internet, any kind of virtual private network, etc., or may be implemented using satellite links, terrestrial media or any other suitable media. The WARN wireless link 136 and WARN network 180 communication path is configured to allow the WARN 130 to communicate with the alert node 150. WARN network 180 and ATTN network 170 may be the same or separate networks depending on the application and in the preferred embodiment are preferably the same network. The alert node is preferably configured to communicate with the WARN network 180 over an AN wireless link 156*a*.

Preferably the PAWS 110 includes an administration node 160. The administration node 160 is configured to receive administrative and overhead information from the ATTN 120, the WARN 130 and the alert node 150 from the WARN wireless link 136, the WARN network 180, the ATTN wireless link 126, the ATTN network 170, the alert node 150 and the alert node wireless link 156. Alert node 150 can be configured to allow the administration node 160 to access current event reporting in real time, examine logged events, monitor operation of the WARN 130 and ATTN 120, copy any logged information, allow third-party access to this information, or even provide an option of sending messages directly to the WARN 130, ATTN 120 or to the warning device 190 through the WARN 130.

While FIG. 4 depicts one ATTN 120, WARN 130, warning device 190 and alert node 150, it is to be understood that there can be multiple ATTNs, WARNs and warning devices that communicate with a single alert node 150. In addition, in a PAWS network there may be multiple alert nodes 150 that can be configured to communicate with each other.

Figure 5:
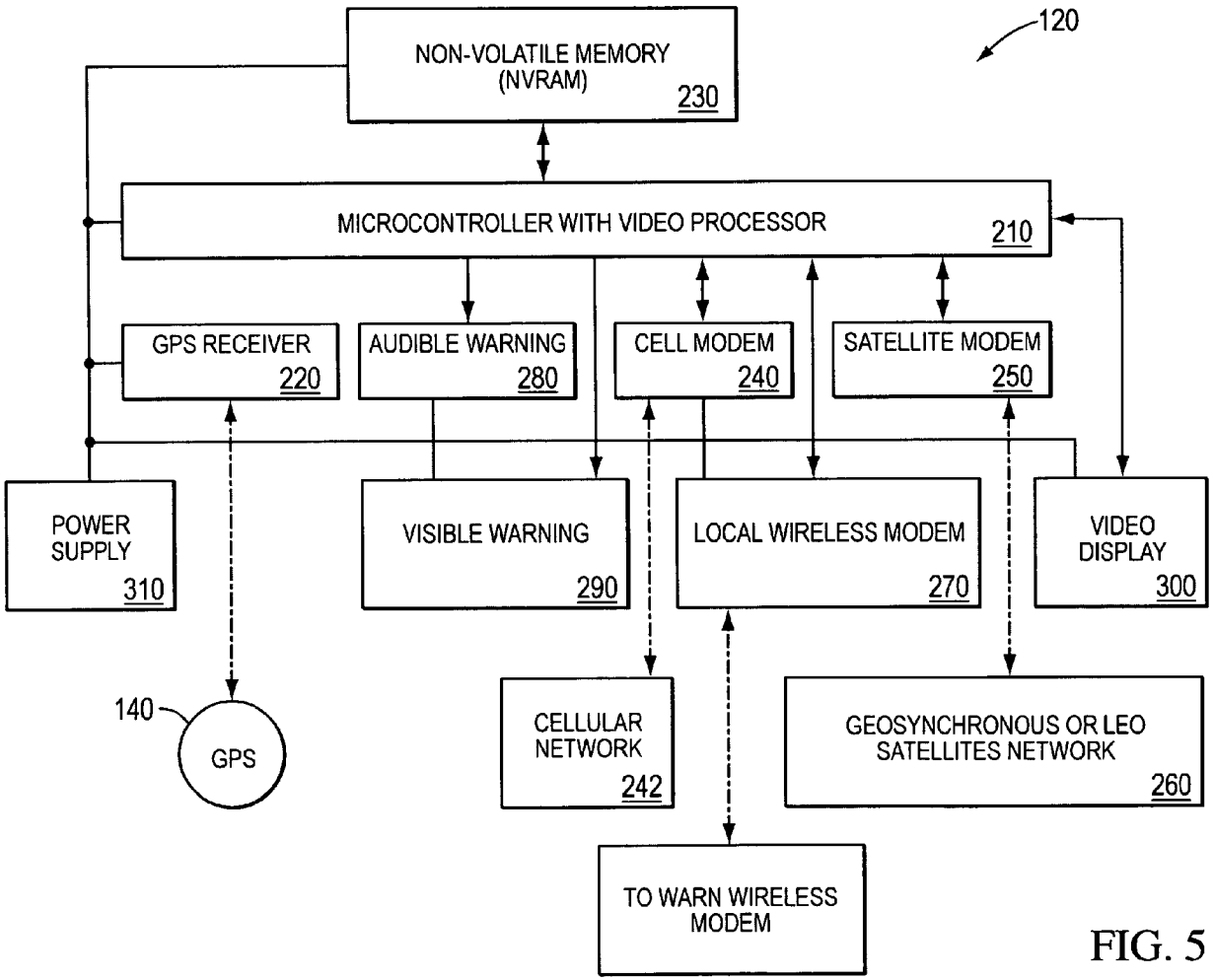
FIG. 5 is a schematic representation of a preferred Warning Alert Response Node (WARN).

FIG. 5 depicts a preferred ATTN 120 in more detail. In this embodiment ATTN 120 comprises a microcontroller 210, a satellite navigation system receiver 220 which is configured to wirelessly connect to a satellite navigation system network 140 to obtain the position of the ATTN 120, and a cell modem 240. Cell modem 240 enables microcontroller's 210 connection with cellular network 242, which facilitates wireless communications between ATTN 120, alert node 150 and administrative node 160. Alternatively, the ATTN 120 may comprise a satellite modem 250 for communication between the ATTN 120, alert node 150 and administrative node 160 through geosynchronous or Low Earth Orbit (LEO) satellites and ground stations 260. If redundancy is desirable from a safety and reliability standpoint, the ATTN 120 may include both a cell modem 240 and a satellite modem 250.

In one embodiment ATTN 120 may also include a local wireless modem 270, allowing the ATTN to communicate directly with a compatible local wireless modem 360 in the WARN 130.

In operation the GPS receiver 220 obtains the vehicle's position information and communicates it to the microcontroller 210. In some embodiments microcontroller 210 accesses information about locations of the WARNs from local non-volatile random-access memory (NVRAM) and calculates the set of WARNs of interest based on this information. Alternatively, the microcontroller 210 can transmit this information to the alert node 150 via a satellite network or a cellular network using the appropriate modem. The alert node 150 is configured to log the position information with time stamps, access data about WARNs' locations and formulate a list of WARNs to be notified of the approaching vehicle.

ATTN 120 is also preferably equipped with an audible warning device 280, such as a siren, a buzzer or a beeper, and visual warning device 290, for instance, alarm lights, flashing lights, etc. These warning devices are preferably activated by the microcontroller 210. The system can be configured to provide visual and audio warning to the operator of the vehicle when the vehicle approaches a crossing. The ATTN 120 in one embodiment may also include a video display 300 allowing the operator to view the upcoming crossing if the WARN is equipped with a video camera 380. In this embodiment the microcontroller also preferably includes a video processor.

In the preferred embodiment the ATTN 120 is powered by any convenient power source such as the vehicle's battery.

Figure 6:
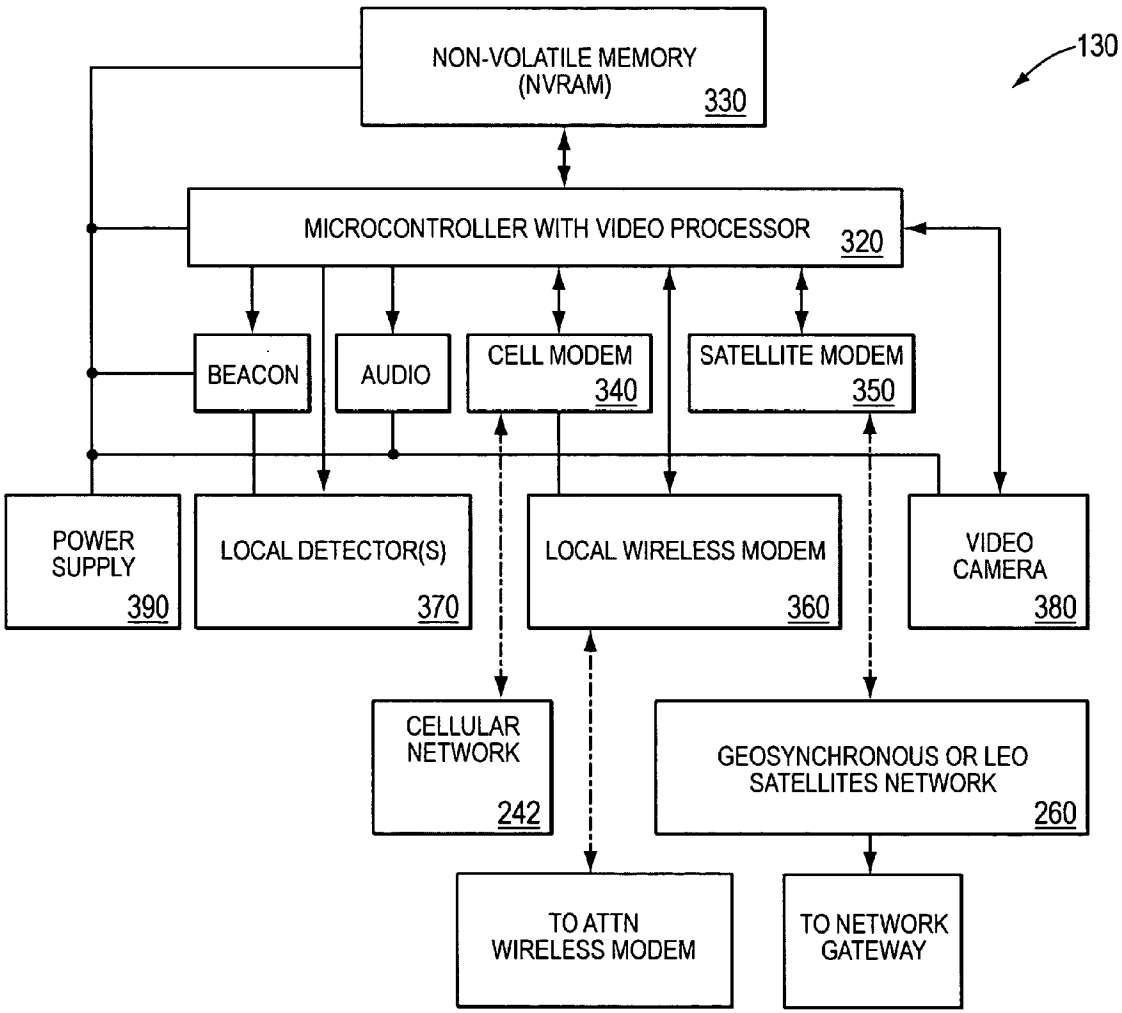
FIG. 6 is a schematic representation of a preferred Alert Trigger Transmit Node (ATTN).

FIG. 6 depicts a preferred WARN 130 in more detail. WARN 130 in this embodiment comprises a microcontroller 320, which can access a storage device 330, preferably a non-volatile random access memory (NVRAM). WARN 130 preferably includes a cell modem 340 for communication with a cellular network. As with the ATTN, the WARN may alternatively include a satellite modem 350 for communication with a satellite network and/or may include both modems for redundancy and safety. The cell modem 340 is configured to wirelessly connect WARN 130 to a cellular network 242. If a satellite modem 350 is used it preferably provides communication through a geosynchronous or LEO satellite network 260. WARN 130 can also include a local wireless modem 360 wirelessly connecting WARN 130 with a compatible ATTN wireless modem 270. Additionally, WARN can include local detectors 370, such as radars or laser speed detection and ranging devices to independently activate the WARN 130 and turn on the warning devices at the crossing in case of network failure. The WARN 130 may be equipped with a video camera 380, and a video processor, and may be capable of video-recording the crossing and transmitting video images of the crossing to the ATTN's video display 300 and/or to alert nodes 150 and administrative node 160 of the system. In this embodiment, the operator of the vehicle and/or operator at the control center can receive information about the conditions at the crossing. The system may also store these images for future reference. WARN 130 is powered by an AC Power supply or preferably a solar power supply 390, or, most preferably, by both.

In some embodiments WARN 130 is equipped with a satellite navigation system receiver and periodically transmits its position information to server nodes. Based on this information, the system then updates the WARN location database used to calculate the set of WARNs within the warning zone of the ATTNs.

Figure 7:
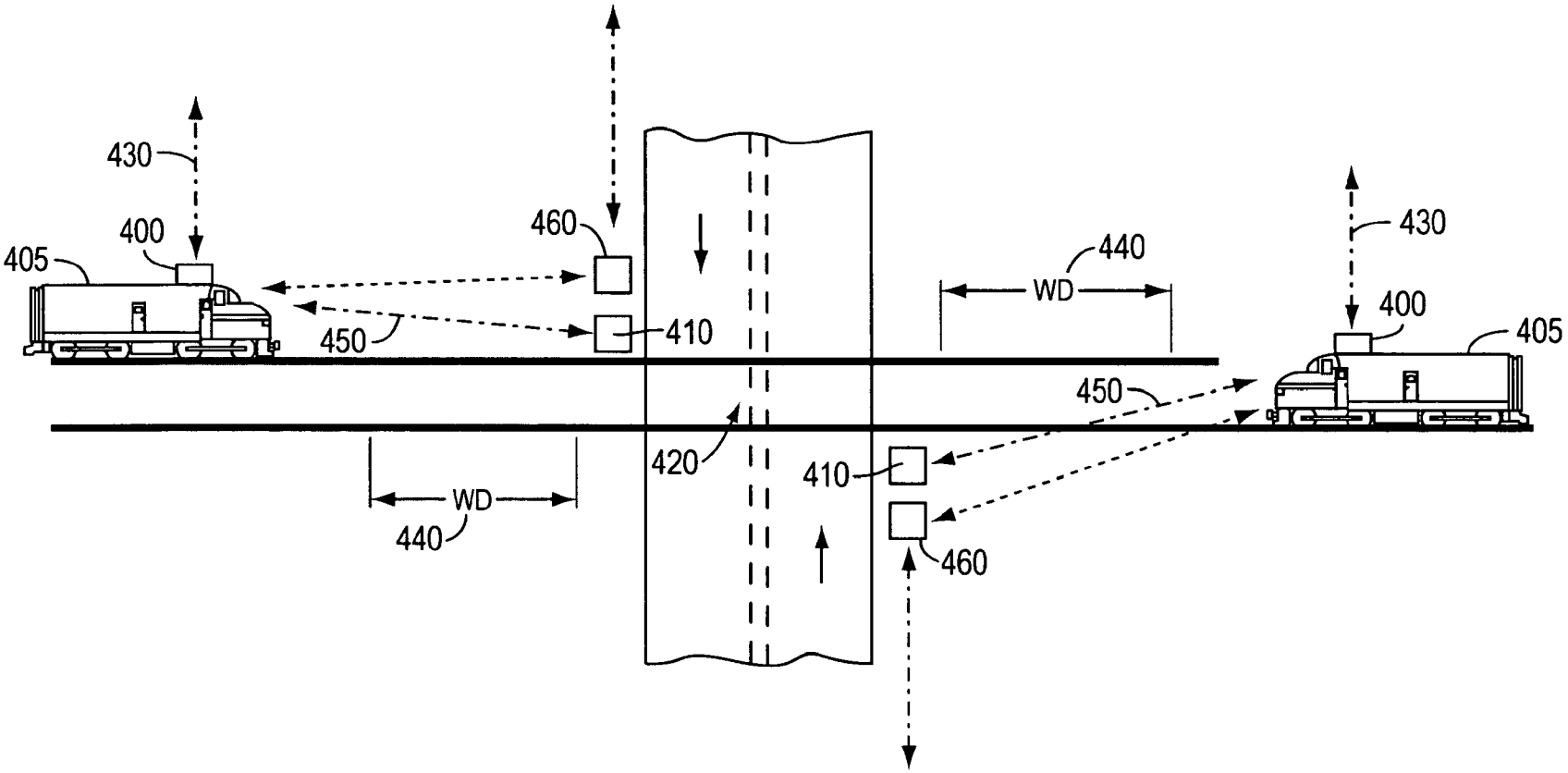
FIG. 7 is a schematic representation of a preferred railway crossing embodiment of the present invention.

FIG. 7 depicts a railway crossing embodiment of the invention. In this example the vehicle carrying an ATTN 400 is a locomotive 405. WARNs 410 are located next to a railway crossing 420. ATTNs 400 obtain position information of the corresponding locomotive by a satellite link 430.

For example, when the locomotive 405 has entered a warning zone 440 as determined by repetitive samplings of GPS position data compared to the warning zone entry position, the ATTN 400 wirelessly transmits this information to the alert node (not shown). The alert node then calculates the speed of the locomotive and the consequent time to reach the WARNs 410, and hence when the WARN is to activate the warning devices as a function of the current position of the train, its speed, and the configurable warning period prior the arrival of the train at the WARN 410. The alert node then repeats this process until the configurable warning period occurs, and at that point wirelessly transmits the activation command to the WARN. The server also logs this information in a data base, from which a variety of administrative node-based applications (not shown) can display, for example, ATTN-specific data, WARN-specific data, or route-specific data historically and in real time. Alternatively, ATTNs 400 at the locomotives 405 can generate a local wireless signal 450 by a local wireless link to alert the WARNs 410 of the locomotive's approach, or the WARNs 410 may be equipped with local detectors 460 (such as radars or visual detectors) operating to detect the upcoming locomotives.

In order to deactivate warning devices, the system can determine when the end-of-train 405 has passed the WARN 410 by periodically sampling the state of a local WARN-based detector (not shown) until the detector shows no train present, and then based on the calibrated distance from the WARN that the detector ceases to detect the train, the worst-case width of the crossing, and the speed of the train, the WARN 410 determines when to deactivate the warning devices. When that time arrives, the WARN 410 deactivates the warning devices, and sends this information to the alert node (not shown), which logs the information as described above.

Figure 8:
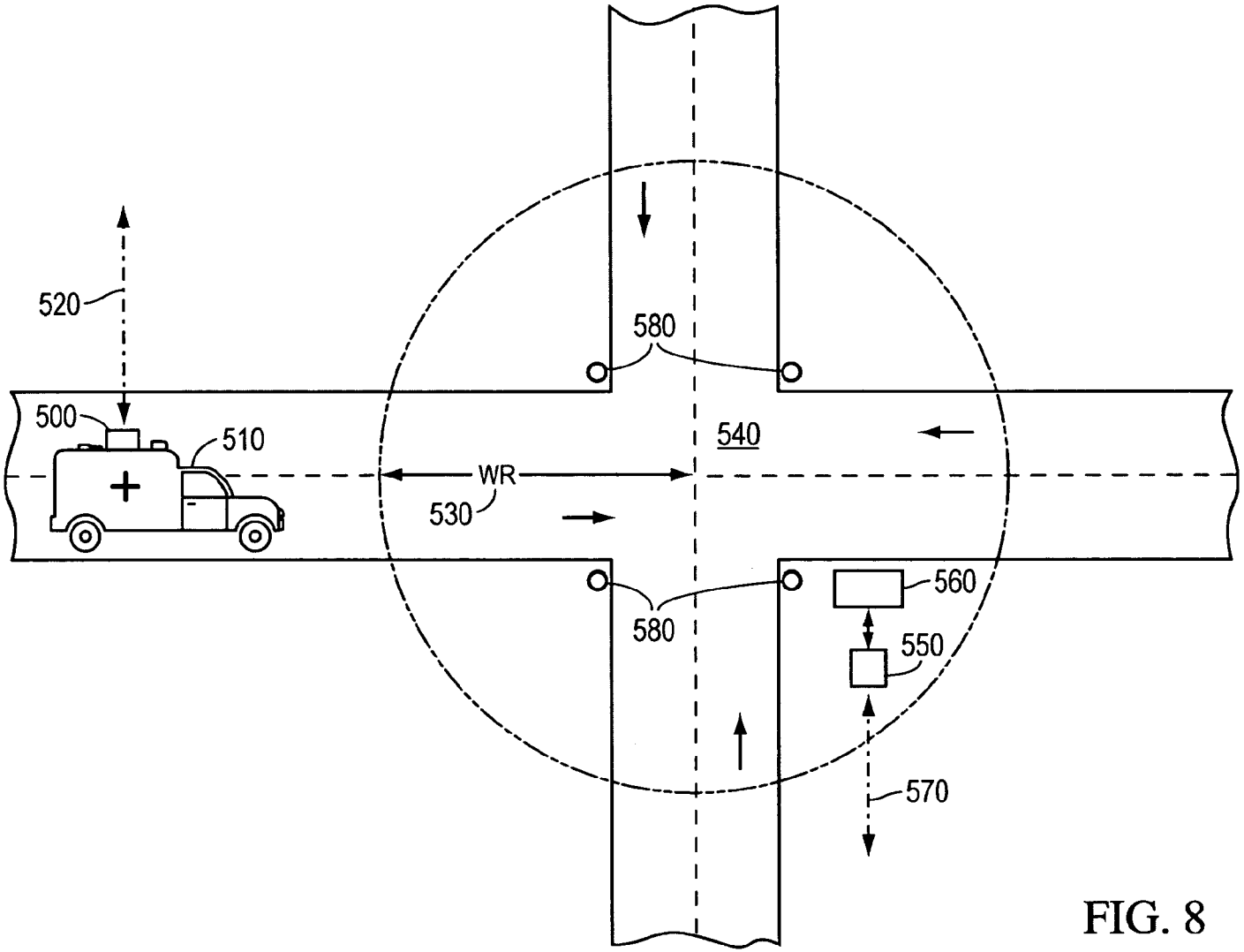
FIG. 8 is a schematic representation of a preferred roadway intersection embodiment of the present invention.

FIG. 8 depicts an embodiment of the invention where ATTN 500 is located on an emergency vehicle 510. ATTN 500 obtains position information of the vehicle 510 by a satellite or cell link 520 and transmits it to a network dispatch unit. Based on this information, the system determines whether the emergency vehicle 510 is within warning radius 530 of an intersection 540 equipped with WARN 550 and signal controller 560. The system generates instructions to the WARN 550 based on information about location and destination of the vehicle 510 and transmits them to the WARN 550 by satellite or cell link 570. The WARN 550 generates instructions to signal controller 560, which in turn switches traffic signals 580 to allow fast and safe passing of the emergency vehicle 510.

In one of the embodiments, based on the location and the destination of the vehicle 510, the alert node (not shown) generates the expected route of the vehicle and sends appropriate commands to the WARNs along the expected route. In one of the embodiments, the route may be generated by a mapping service (for example, Mapquest, Yahoo Maps, etc.)

Should the vehicle 510 deviate from its expected route based upon data gathered by its ATTN 500 on an ongoing basis and sent to the alert node, the alert node could adjust what WARNs to activate. Similarly, based on the same data stream, the alert node would deactivate WARNs when the emergency vehicle had safely passed a given WARN.

Figure 9:
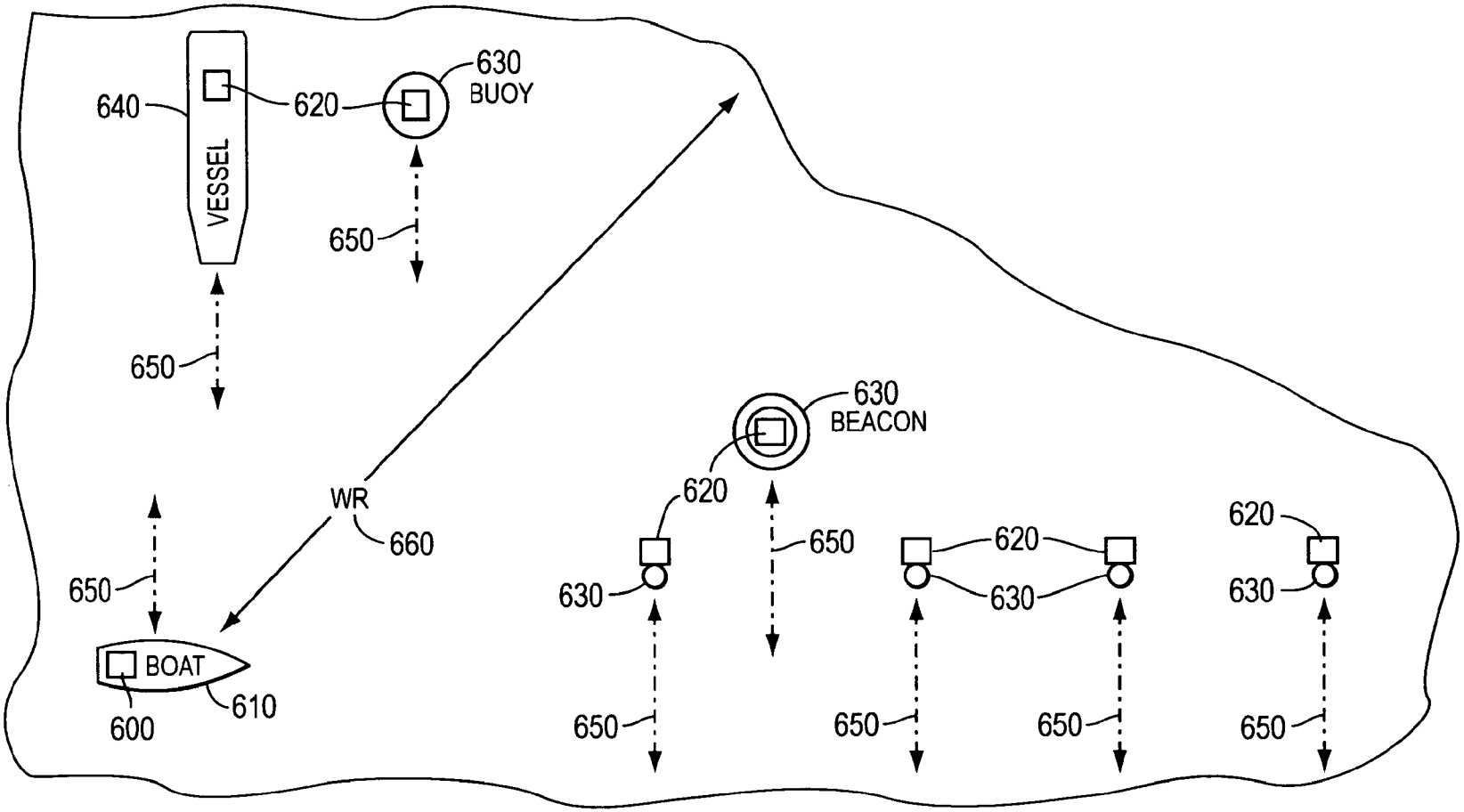
FIG. 9 is a schematic representation of a preferred waterway embodiment of the present invention.

FIG. 9 depicts an embodiment of the invention where WARN 600 is located on a small watercraft 610. ATTNs 620 are located on navigation obstacles or navigation signaling devices 630 such as buoys, stationary beacons, channel markers, etc. Also ATTNs 620 can be located on larger watercraft 640. By satellite or cell link 650 the ATTNs 620 and the WARNs 600 obtain position information of their respective carriers and transmit this information to the alert node (not shown). If the alert node detects any of the ATTN-carrying objects within warning radius 660 of the WARN-carrying small watercraft 610, the alert node sends wireless alert signal to the WARN 600 which activates warning devices (not shown) on the watercraft 610 and alerts the crew to the approaching danger. This same data stream can also be used to display the real time positions of the small watercraft 610, the large watercraft 640, as well as the aids and hazards to navigation 630 against a mapping service background of the vicinity.

The invention claimed is:

1. A warning system comprising:

at least one alert zone defined by at least one set of coordinate pairs;

at least one wireless alert trigger node attached to a vehicle, configured to generate a wireless alert signal based on whether the position of the vehicle corresponds to the coordinate pair;

at least one warning alert response node configured to receive the wireless alert signal and generate a warning activation signal;

at least one warning device configured to receive the warning activation signal and generate a warning in response to said warning activation signal.

2. The warning system of claim 1 wherein the at least one set of coordinate pairs is a predetermined set of coordinate pairs.

3. The warning system of claim 1 wherein the at least one set of coordinate pairs is a variable set of coordinate pairs.

4. The warning system of claim 1 wherein the at least one warning device is stationary.

5. The warning system of claim 1 wherein the at least one warning device is attached to the vehicle.

6. The warning system of claim 1 wherein the wireless alert trigger node includes a transmitter configured to transmit the wireless alert signal through a network selected from the group of a cellular network, a satellite network and a local wireless network.

7. The warning system of claim 1 wherein the wireless alert response node includes a transmitter configured to transmit the warning activation signal through a network selected from the group of a cellular network, a satellite network and a local wireless network.

8. The warning system of claim 1 wherein the wireless alert trigger node transmits the wireless alert signal through a combination of at least two networks selected from the group of a cellular network, a satellite network and a local wireless network.

9. The warning system of claim 1 wherein the wireless alert response node transmits the warning activation signal through a combination of at least two networks selected from the group of a cellular network, a satellite network and a local wireless network.

10. The warning system of claim 1 wherein the wireless alert trigger node further comprises a satellite navigation system receiver configured to receive position information from a satellite navigation system network and generate a position signal;

an alert signal generator configured to generate the wireless alert signal based in part upon the position signal.

11. The warning system of claim 10 wherein the satellite navigation system receiver is a GPS receiver and the satellite navigation system network is a GPS network.

12. The warning system of claim 10 wherein the wireless alert trigger node further comprises a microcontroller and an alert zone storage medium storing the sets of coordinate pairs defining the at least one alert zone;

the microcontroller is configured to receive the position signal from the satellite navigation system receiver as an input and to access the stationary predetermined location storage medium;

the microcontroller is further configured to determine whether the position of the vehicle corresponds to at least one of the coordinate pairs defining the at least one alert zone.

13. The warning system of claim 12 wherein the alert zone storage medium is a Non-Volatile Random Access Memory (NVRAM).

14. The warning system of claim 12 wherein the stationary predetermined location storage medium is a Flash or similar memory.

15. The warning system of claim 12 wherein the alert zone storage medium is a hard drive.

16. The warning system of claim 12 wherein the alert zone storage medium is a DVD.

17. The warning system of claim 12 wherein the at least one alert zone defined by the at least one set of coordinate pairs varies depending on current weather conditions at a location corresponding to at least one of the coordinate pairs or the location of the at least one warning device.

18. The warning system of claim 1 wherein the vehicle is a locomotive or a railcar.

19. The warning system of claim 18 wherein the warning device is located at a rail crossing.

20. The warning of claim 18 wherein the warning device is attached to the locomotive or the railcar.

21. The warning system of claim 1 wherein at least one warning device is selected from the group consisting of a beacon, an audio device, a crossing gate, in-road warning lights, a traffic signal, and a warning display.

22. The warning system of claim 1 wherein the vehicle is an emergency vehicle, the at least one wireless alert response node is configured to communicate with a traffic signal and to manipulate the traffic signal based on the position of the emergency vehicle to halt traffic at an intersection where the traffic signal is located until the emergency vehicle passes through the intersection.

23. The warning system of claim 1 wherein the vehicle is a small watercraft.

24. The warning system of claim 23 wherein the at least one wireless alert response node is located on a navigation aid or obstacle.

25. The warning system of claim 23 wherein the at least one wireless alert response node is attached to the watercraft.

26. The warning system of claim 23 wherein the navigation aid(s) or obstacle(s) equipped with the wireless alert response node are selected from the group consisting of buoys, stationary beacons, channel markers and large watercraft.

27. The method of providing a warning of an approaching vehicle comprising:

generating a wireless alert signal based on whether the position of the vehicle corresponds to at least one of coordinate pairs from a set of coordinate pairs defining at least one alert zone;

receiving said wireless alert signal;

generating a warning activation signal;

receiving said warning activation signal;

generating a warning in response to the warning activation signal, wherein the warning is generated so that the warning is most likely to reach the intended audience.

28. The method of claim 27 wherein the set of coordinate pairs defining the at least one alert zone is a predetermined set of coordinate pairs.

29. The method of claim 27 wherein the set of coordinate pairs defining the at least one alert zone is a variable set of coordinate pairs.

30. The method of claim 27 further comprising transmitting the wireless alert signal through a networks selected from the group consisting of a cellular network, a satellite network or a local wireless network.

31. The method of claim 27 further comprising transmitting said warning activation signal through a networks selected from the group consisting of a cellular network, a satellite network or a local wireless network.

32. The method of claim 27 further comprising transmitting said wireless alert signal through a combination of at least two networks selected from the group of a cellular network, a satellite network and a local wireless network.

33. The method of claim 27 further comprising transmitting said warning activation signal through a combination of at least two networks selected from the group of a cellular network, a satellite network and a local wireless network.

34. The method of claim 27 further comprising receiving a position information of the vehicle;

generating a position signal based on the position information of the vehicle;

generating the wireless alert signal based at least in part upon the position signal.

35. The method of claim 34 further comprising accessing an alert zone storage medium;

retrieving information regarding the at least one set of coordinate pairs defining the at least one alert zone;

determining whether the position of the vehicle corresponds to at least one coordinate pair from the at least one set of coordinate pairs at least in part based on the position signal.

36. The method of claim 35 wherein the alert zone storage medium is a non-volatile random access memory.

37. The method of claim 35 wherein the alert zone storage medium is a Flash memory.

38. The method of claim 35 wherein the alert zone storage medium is a Hard drive.

39. The method of claim 35 wherein the alert zone storage medium is a DVD.

40. The method of claim 35 wherein the at least one set of coordinate pairs defining the at least one alert zone varies depending in current weather conditions at a location corresponding to at least one of the coordinate pairs of on location of a warning device producing the warning.

41. The method of claim 34 wherein the position signal is generated by a satellite navigation system.

42. The method of claim 41 wherein the satellite navigation system is a Global Positioning System (GPS).

43. A warning system comprising:

a position transmitter attached to a vehicle, configured to transmit wireless vehicle position information;

a host alert node;

at least one warning alert response node;

at least one alert zone defined by at least one set of coordinate pairs;

at least one warning device;

wherein the host alert node is configured to determine whether the position of the vehicle corresponds to the coordinate pair from the at least one set of coordinate pairs at least in part based on the wireless vehicle position information and to transmit alert information to the at least one warning alert response node when the position of the vehicle corresponds to the at least one coordinate pair;

the warning alert response node is configured to receive the alert information and to output an alert activation signal to the warning device;

the warning device is configured to receive as an input the alert activation signal and to generate a warning in response to the alert activation signal;

the warning device being positioned such as to alert interested parties.

44. The warning system of claim 43 wherein the at least alert zone defined by the one set of coordinate pairs is predetermined alert zone.

45. The warning system of claim 43 wherein the at least alert zone defined by the at least one set of coordinate pairs is a variable alert zone.

46. The warning system of claim 43 wherein the warning device is attached to the vehicle.

47. The warning system of claim 43 wherein the warning device is stationary and is located at a stationary predetermined location.

48. The warning system of claim 47 comprising at least two alert zones and at least one stationary warning device in each alert zone, wherein the host alert node is configured to determine whether the position of the vehicle corresponds to the coordinate pair from the set of coordinate pairs comprising one of the alert zones based on the wireless vehicle position information and wherein the alert information comprises alert zone information, the alert zone information including information identifying which alert zone the vehicle is in; and the warning alert response node is configured to output the alert activation signal to the stationary warning device located within the alert zone in which the vehicle is located.

49. The warning system of claim 43 wherein the wireless vehicle position information is transmitted to the host alert node through a network selected from the group of a cellular network, a satellite network and a local wireless network.

50. The warning system of claim 43 wherein the alert information is transmitted to the warning alert response node through a network selected from the group of a cellular network, a satellite network and a local wireless network.

51. The warning system of claim 43 wherein the wireless vehicle position information is transmitted to the host alert node through a combination of at least two networks selected from the group of a cellular network, a satellite network and a local wireless network.

52. The warning system of claim 43 wherein the alert information is transmitted to the warning alert response node through a combination of at least two networks selected from the group of a cellular network, a satellite network and a local wireless network.

53. The warning system of claim 43 wherein the system further comprises a satellite navigation system receiver configured to receive position information from a satellite navigation system network and communicate position information to the position transmitter.

54. The warning system of claim 53 wherein the satellite navigation system receiver is a GPS receiver and the satellite navigation system network is the GPS or similar network.

55. The warning system of claim 43 wherein the system comprises a plurality of alert zones, a plurality of warning alert response nodes and a plurality of warning devices wherein each of the plurality of warning alert response nodes is associated with one or more warning devices; and wherein at least one of the warning devices is associate with one of the plurality of alert zones;

wherein the host alert node further comprises an alert zone storage medium storing the sets of coordinate pairs comprising the alert zones;

the host alert node is configured to analyze the wireless vehicle position information and determine whether the vehicle is located in any of the plurality of alert zones based at least in part on the wireless vehicle position information using the sets of coordinate pairs stored in the alert zone storage medium;

the host alert node is further configured to determine which of the plurality of warning alert response nodes should receive the alert information and to transmit the alert information to the appropriate warning alert response node.

56. the warning system of claim 55 wherein the alert zone storage medium is a Non-Volatile Random Access Memory (NVRAM).

57. The warning system of claim 55 wherein the alert zone storage medium is a Flash or similar memory.

58. The warning system of claim 55 wherein the alert zone storage medium is a hard drive.

59. The warning system of claim 55 wherein the alert zone storage medium is a DVD.

* * * * *

UNITED STATES PATENT AND TRADEMARK OFFICE

CERTIFICATE OF CORRECTION

PATENT NO. : 8,193,949 B2
APPLICATION NO. : 12/851487
DATED : June 5, 2012
INVENTOR(S) : Chester Allen Burns It is certified that error appears in the above-identified patent and that said Letters Patent is hereby corrected as shown below:

Column 9

Line 10, “said” should read --the--

Column 10

Line 41, “The” should read --A--

Column 11

Line 37, “in” should read --on--

Column 12

Line 2, “is” should read --is a--

Line 61, “associated” should read --associate--

Signed and Sealed this
Fourteenth Day of August, 2012

David J. Kappos

David J. Kappos
*Director of the United States Patent and Trademark Office*